US007978143B2

(12) United States Patent
Degutis et al.

(10) Patent No.: US 7,978,143 B2
(45) Date of Patent: Jul. 12, 2011

(54) MULTIBAND JAMMING ANTENNA

(75) Inventors: Daniel J. Degutis, Odenton, MD (US); Brian Molen, Columbia, MD (US)

(73) Assignee: Antenna Research Associates, Inc., Beltsville, MD (US)

( * ) Notice: Subject to any disclaimer, the term of this patent is extended or adjusted under 35 U.S.C. 154(b) by 444 days.

(21) Appl. No.: 12/287,778

(22) Filed: Oct. 14, 2008

(65) Prior Publication Data

US 2010/0090920 A1 Apr. 15, 2010

(51) Int. Cl.
*H01Q 9/16* (2006.01)

(52) U.S. Cl. ..... 343/793

(58) Field of Classification Search ..... 343/790–795, 343/711–713, 834–835, 773
See application file for complete search history.

(56) References Cited

U.S. PATENT DOCUMENTS 5,293,176 A * 3/1994 Elliot ..... 343/797
5,523,767 A * 6/1996 McCorkle ..... 343/810
6,268,834 B1 * 7/2001 Josypenko ..... 343/773
6,621,462 B2 * 9/2003 Barnes ..... 343/787
2002/0154064 A1 * 10/2002 Barnes ..... 343/770
2005/0110687 A1 * 5/2005 Starkie et al. ..... 343/700 MS
2009/0213025 A1 * 8/2009 Coupez et al. ..... 343/807

* cited by examiner

*Primary Examiner* — Huedung Mancuso
(74) *Attorney, Agent, or Firm* — Kenneth W. Roat

(57) ABSTRACT

Disclosed is a multiband jamming antenna for use with RF jamming systems. An exemplary embodiment of the antenna comprises high-band, medium-band and low-band radiating structures arranged in a collinear manner. The three radiating structures are operable in three respective overlapping frequency bands. In the exemplary embodiment, the high-band radiating structure comprises a hybrid biconical/dipole antenna disposed at an upper end of the antenna. The medium-band radiating structure is collinearly coupled to the high-band radiating structure and comprises upper and lower dipole elements that are tuned using a dual section coaxial transformer. The low-band radiating structure is collinearly coupled to the medium-band radiating structure. The low-band radiating structure comprises a coaxial Ruthroff UNUN transformer that is coupled to the low-band radiating structure, and a feeder cable that connected to the coaxial Ruthroff UNUN transformer, and the high-band, medium-band, and low-band radiating structures.

10 Claims, 5 Drawing Sheets

MULTIBAND JAMMING ANTENNA

BACKGROUND

The present invention relates generally to antennas, and more particularly, to a multiband jamming antenna for use with radio frequency (RF) jamming systems, and the like.

During military conflicts, and particularly in the middle-East, service personnel and noncombatants have been killed and injured by improvised explosive devices (IEDs) used by insurgents. The improvised explosive devices are remotely detonated using RF signals transmitted by handheld RF transmitters. In order to counteract the improvised explosive devices, the military has used active jamming devices to jam the transmitted RF signals intended to detonate the devices.

Conventional wideband jamming antennas typically cover a 20 MHz to 3 GHz frequency range. These conventional wideband jamming antennas typically employ two antennas to provide adequate gain and antenna pattern performance across the operating frequency bandwidth. Since the conventional wideband jamming systems require two antennas on each vehicle, more vehicle real estate is required to mount the antennas which is undesirable. It would also be desirable to provide improved performance using only one antenna.

There is a need for an improved jamming antenna that allows wideband coverage while minimizing the number of antennas and real estate required for mounting it on a vehicle.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
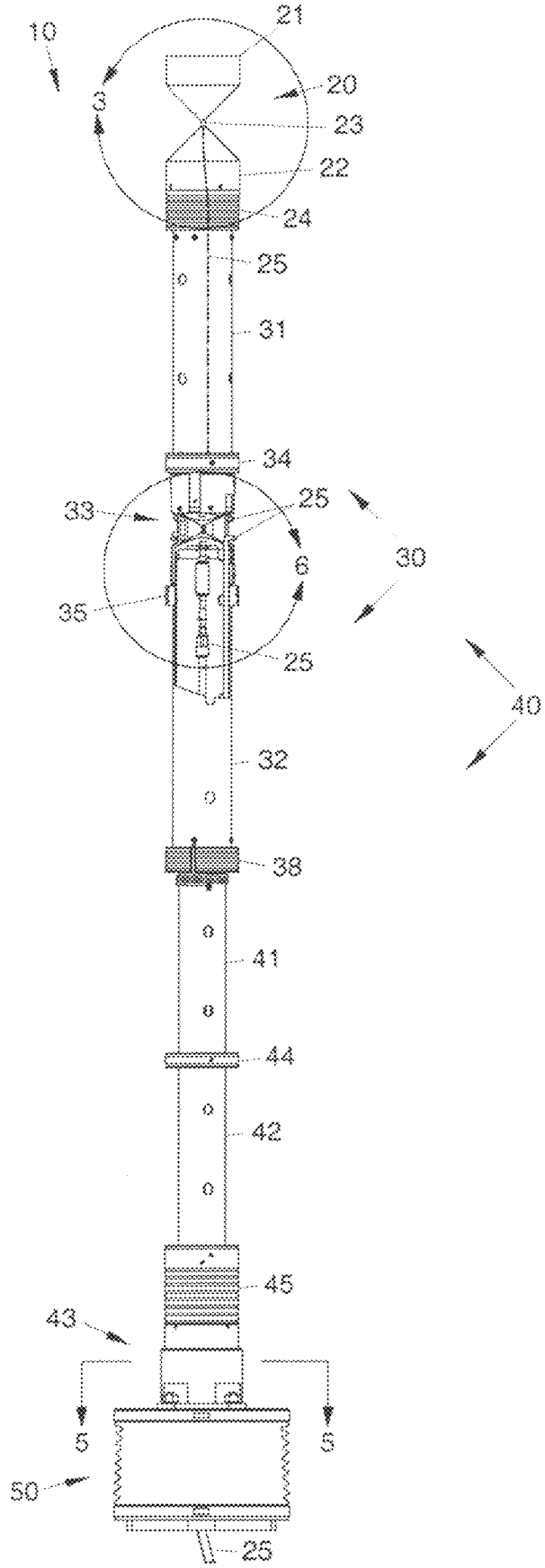
FIG. 1 shows a side view of an exemplary wideband jamming antenna.
Figure 2:
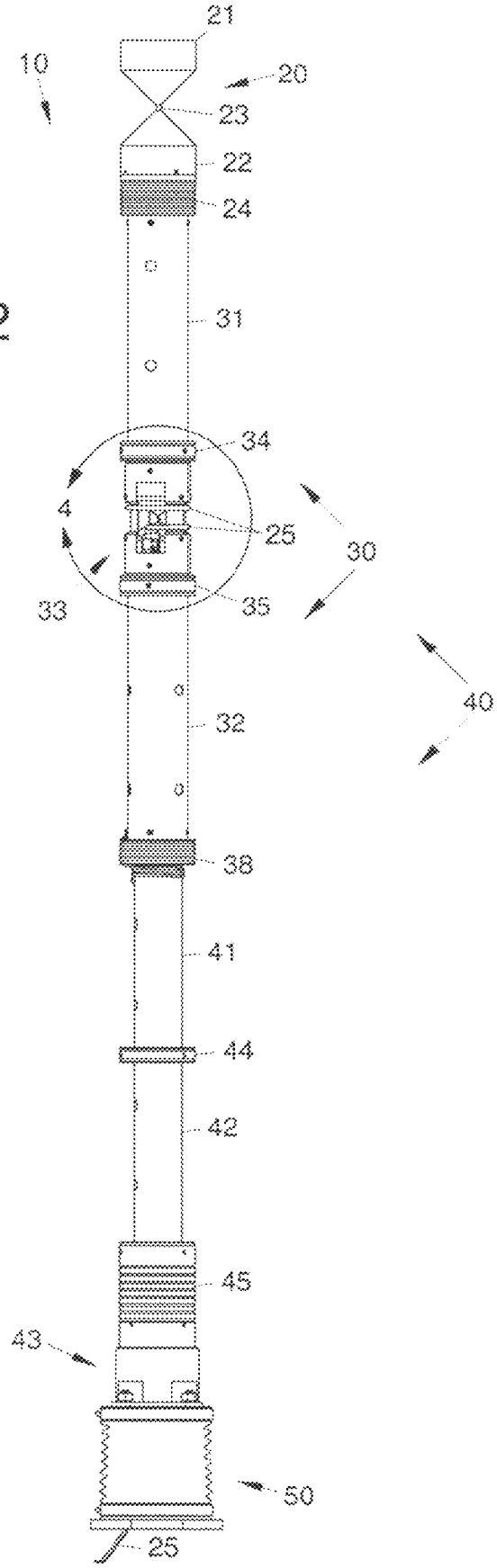
FIG. 2 shows an orthogonal side view of the exemplary wideband jamming antenna.

Referring to the drawing figures, disclosed is an exemplary wideband RF jamming antenna 10, that is particularly well-suited for military vehicle use. FIG. 1 shows a side view of an exemplary wideband jamming antenna 10 while FIG. 2 shows an orthogonal side view of the antenna 10. The exemplary antenna 10 is an extremely wideband, high power radiator, having about twice the frequency bandwidth compared to conventional jamming antennas. The antenna 10 was specifically designed for use in military vehicular RF jamming systems employed to defeat improvised explosive devices (IEDs), and the like.

The antenna 10 operates over a wide bandwidth and has a singular "stick" type structure. The antenna 10 has a unique antenna feeding arrangement, which will be described in more detail below. The antenna 10 also takes up less vehicle "real estate" that conventional designs, since only one antenna is required (not two as in conventional jamming systems).

The antenna 10 provides multi-band output operation with minimal channel-to-channel coupling. The antenna 10 covers a frequency bandwidth of 20 MHz to 6 GHz, while currently-available jamming antennas typically cover a 20 MHz to 3 GHz frequency bandwidth.

More particularly, the antenna 10 comprises three radiating structures 40, 30, 20 in a collinear arrangement, that are operable in three respective overlapping frequency bands (20 MHz to 500 MHz, 120 MHz to 1 GHz and 500 MHz to 6 GHz). The antenna 10 employs a feeder cable 25, or feeder cable system 25, that is integrated into the antenna 10 so as not to produce undesirable pattern defects typical of conventional multi-band antennas. This allows a jamming system coupled to the antenna 10 to have significantly fewer "weak spots" thereby allowing it to prevent most, if not all, IED detonations.

As shown in FIGS. 1 and 2, the antenna 10 comprises three distinct, yet integrated, radiating structures 20, 30, 40, one for each frequency band (i.e., a high-band radiating structure 20, a medium-band radiating structure 30, and a low-band radiating structure 40).

Figure 3:
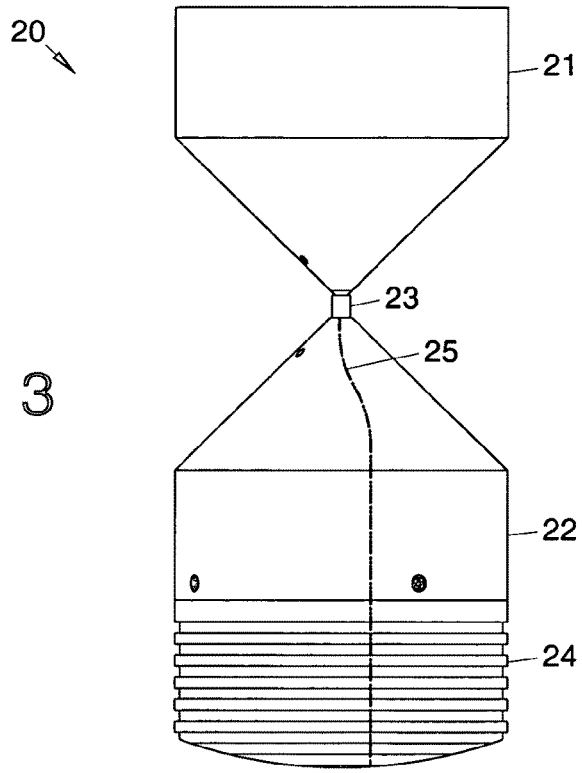
FIG. 3 shows an enlarged view of a portion of the antenna encircled by the line 3 in FIG. 1.

The high-band radiating structure 20 comprises a hybrid biconical/dipole antenna 20 that is disposed at the top of the antenna 10. FIG. 3 shows an enlarged view of a top portion of the antenna 10 encircled by the line 3 in FIG. 1. FIG. 3 shows details of the hybrid biconical dipole radiating structure 20 employed in the exemplary antenna 10. The hybrid biconical dipole radiating structure 20 comprises the high band radiating structure 20 of the antenna 10.

The hybrid biconical dipole radiating structure 20 comprises an upper tapered conical dipole radiating element 21 and a lower tapered conical dipole radiating element 22. The upper and lower tapered conical dipole radiating elements 21, 22 are coupled to a balun 23 at their respective pointed ends. The lower tapered conical dipole radiating element 22 is connected at its lower end to a first coupler 24 by means of a plurality of machine screws, for example.

The feeder cable 25 is coupled to the high band radiating structure 20 and terminates at the balun 23 and extends below the high band radiating structure 20, traverses through the mid-band radiating structure 30, and also acts as a component of the low-band radiating structure 40.

Figure 4:
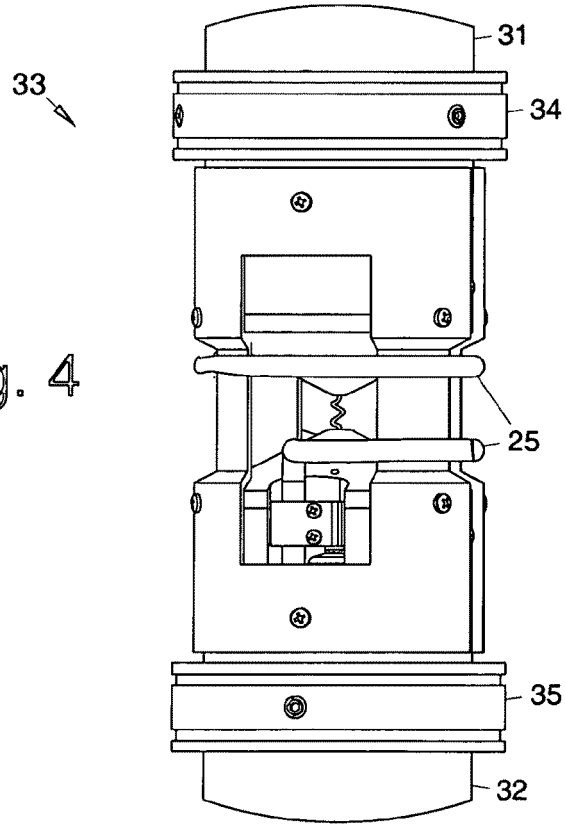
FIG. 4 shows an enlarged view of a portion of the antenna encircled by the line 4 in FIG. 2.
Figure 6:
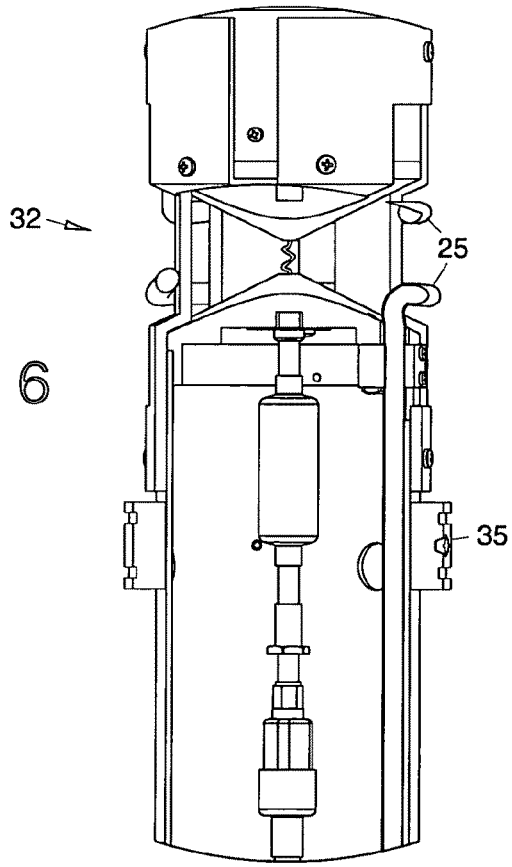
FIG. 6 shows an enlarged view of a portion of the antenna encircled by the line 6 in FIG. 1.

The mid-band radiating structure 30 is a wideband dipole having upper and lower dipole elements 31, 32 and comprises, and is tuned with, a dual section coaxial transformer 33. FIG. 6 shows an enlarged view of a portion of the antenna 10 encircled by the line 6 in FIG. 1. More particularly, FIG. 6 shows details of an exemplary coaxial transformer 33 employed in the antenna 10. FIG. 4 shows an enlarged view of a portion of the antenna 10 encircled by the line 4 in FIG. 2, and shows a high-band cable mid-band feed point path of the antenna 10.

The upper dipole element 31 of the mid-band radiating structure 30 is coupled to a lower end of the first coupler 24 by means of a plurality of machine screws, for example. The upper and lower dipole elements 31, 32 are coupled at their respective proximal ends to the dual section coaxial transformer 33 using upper and lower clamps 34, 35, for example. Both the low-band radiating structure 40 and the high band portion of the feeder cable 25 pass through the center of the mid-band dipole radiating structure 30 and are DC grounded to both dipole elements 31, 32 of the mid-band radiating structure 30.

The path, length and routing location of the feeder cable 25 is important for proper, optimized, operation of the antenna 10. The feeder cable 25 makes a 540 degree arc around a feed point located between the upper and lower dipole elements 31, 32 of the mid-band radiating structure 30 and creates a 180 degree spatial separation between the upper and lower dipole elements 31, 32. This separation mimics the 180 degree phase imbalance inherent in the mid-band dipole radiating structure 30. This arrangement minimally disturbs the performance of the mid-band dipole radiating structure 30 while making possible a three-band antenna 10.

The lower dipole element 32 of the mid-band radiating structure 30 is coupled to an upper end of a second coupler 38 by means of a plurality of machine screws, for example. The lower end of the second coupler 38 is connected to an upper end of a first low band element 41 which is coupled using a clamp 44 to a second low band element 42. A lower end of the second low band element 42 is coupled to a base radome adapter 45 by means of a plurality of machine screws, for example.

Figure 5:
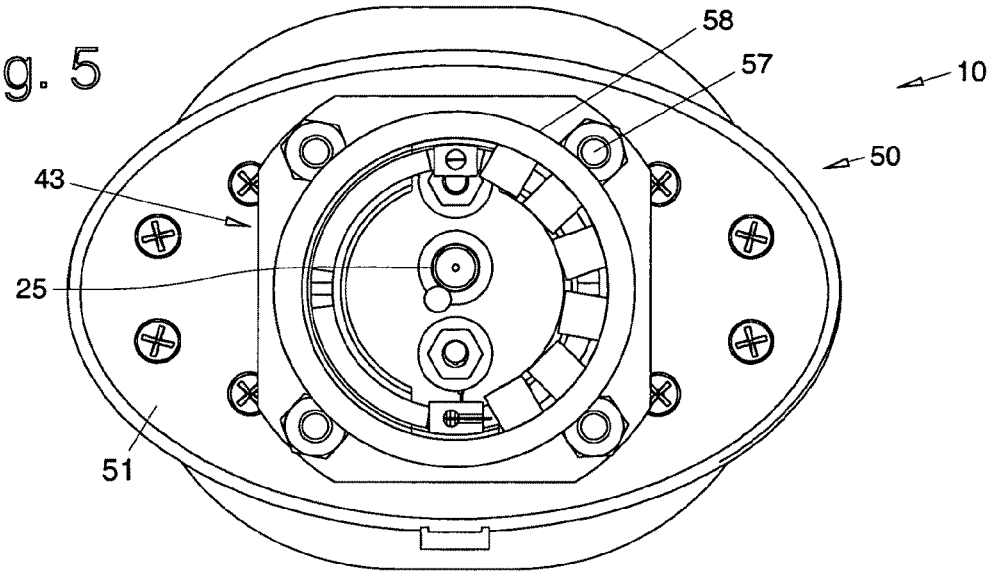
FIG. 5 shows an enlarged cross-sectional view of the antenna taken along the lines 5-5 in FIG. 1.

The low-band radiating structure 40 comprises the entire radiating structure of the antenna 10 functioning as a monopole antenna. The low-band radiating structure 40 is fed at its base using a coaxial implementation of a Ruthroff UNUN (unbalanced to unbalanced transition) transformer 43. FIG. 5 shows an enlarged cross-sectional view of the antenna 10 taken along the lines 5-5 in FIG. 1. More particularly, FIG. 5 shows an exemplary Ruthroff UNUN (unbalanced-to-unbalanced transition) transformer 43 employed in the antenna 10.

This implementation of the Ruthroff UNUN transformer 43 is unique in that a conventional coaxial UNUN of this type uses toroidal cores or linear coaxial arrangements. The coaxial UNUN transformer 43 used in the present antenna 10 routes the feeder cable 25 in a circular pattern around the interior of a base coupling structure 58 to solve two basic design problems. The space required to house the coaxial UNUN transformer 43 is significantly reduced and electrical connections can be much closer together, allowing higher frequency performance.

Figure 7:
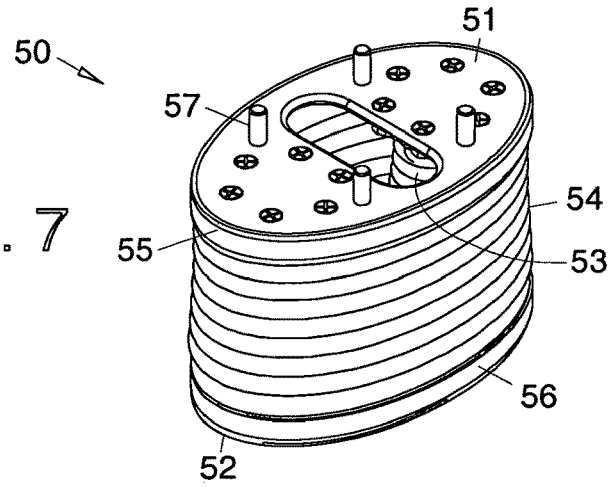
FIG. 7-7*c* show perspective, top, side and end views, respectively, of an exemplary mounting structure for the wide band jamming antenna.
Figure 7A:
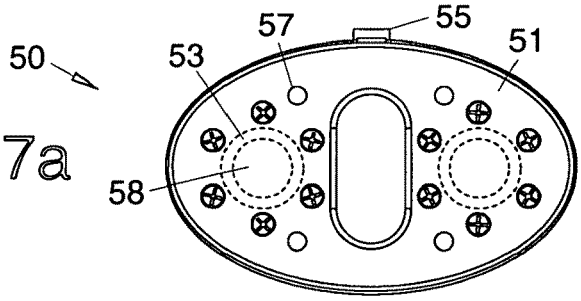
Figure 7B:
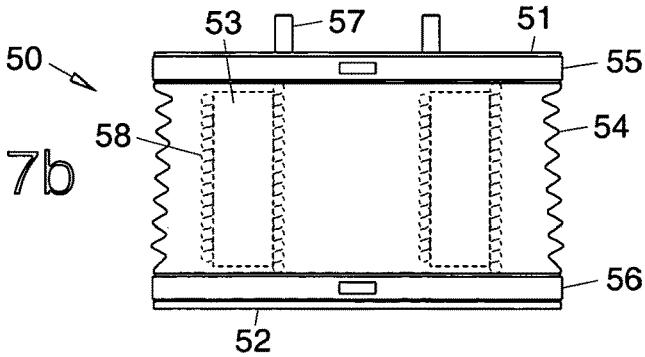
Figure 7C:
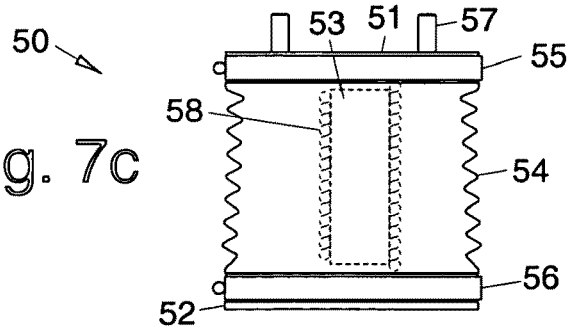

The Ruthroff coaxial UNUN transformer 43, and hence the lower end of the antenna 10, is coupled to a spring-loaded mounting structure 50, such as by using threaded studs 57 (FIG. 5) that extend from the mounting structure 50. FIG. 7-7*c* show perspective, top, side and end views, respectively, of an exemplary mounting structure 50. The spring-loaded mounting structure 50 allows flexing of the antenna 10 if the vehicle on which it is mounted is moving, or if the antenna 10 is impacts something or is subject to wind or other external forces. The spring-loaded mounting structure 50 minimizes shock imparted to internal components of the antennas 10.

Conventional spring-loaded mounting structure utilize only one spring, which limits flexural stability. To overcome the limitations of such conventional mounts, the spring-loaded mounting structure 50 comprises a plurality of (preferably two) internal springs 53 that are coupled to top and bottom plates 51, 52. The two internal springs 53 are disposed in a side by side arrangement. The spring-loaded mounting structure 50 also comprises a flexible bellow 54 that is secured to the top and bottom plates 51, 52 by top and bottom hose clamps 55, 56. A plurality of threaded studs 57 (four, for example) extend from the top plate 51 to allow connection of the base coupling structure 58 to the spring-loaded mounting structure 50.

This side by side spring arrangement doubles the flexing force in the forward-backward directions and at the same time creates substantially more resistance in a side to side flexing mode. This also allows use of material sizes (wire diameter) that can be wound to produce production lots of springs 53 of consistent force. This allows the antenna 10 to flex from a forward impact (by far the most common) while resisting side to side motion created from vehicle turns and rough roads. The shock imposed on internal components of the antenna 10 is minimized and the overall stability of the antenna 10 is increased due to the asymmetrical resistance that is created by the use of two or more side-by-side springs 53.

The springs 53 may also be arranged in an offset pattern. The required bending force can be increased or decreased using varying impact angles created by the offset. This allows for fine-tuning of the antenna mounting structure 50 to optimize the tradeoff between stiffness and shock absorption. Force increases by the cosine of the angle of impact. Also, forward impacts to the antenna 10 result in displacements directed away from the vehicle for safety and vehicle protection. These benefits are not possible with single spring designs.

To add a dampening effect to conventional antenna mounting mechanisms, the industry uses a rubber sleeve disposed over the spring that is hose-clamped in place. In contrast, the springs 53 of the spring-loaded mounting structure 50 have internal molded rubber center elements. A liquid cured type rubber is preferably used to fabricate the molded rubber center elements that is both effective and does not suffer from problems of current industry designs that use clamps that can move or become loose.

Thus, an exemplary multiband jamming antenna for use with RF jamming systems has been disclosed. It is to be understood that the above-described embodiment is merely illustrative of some of the many specific embodiments that represent applications of the principles discussed above. Clearly, numerous and other arrangements can be readily devised by those skilled in the art without departing from the scope of the invention.

What is claimed is:

1. Antenna apparatus, comprising:

a high-band radiating structure that comprises a hybrid biconical/dipole antenna disposed at an upper end of the apparatus;

a medium-band radiating structure collinearly coupled to the high-band radiating structure that comprises upper and lower dipole elements and that is tuned with a dual section coaxial transformer; and a low-band radiating structure collinearly coupled to the medium-band radiating structure that comprises:

a coaxial Ruthroff UNUN transformer coupled to the low-band radiating structure; and a feeder cable connected to the coaxial Ruthroff UNUN transformer, and the high-band, the medium-band, and the low-band radiating structures.

2. The apparatus recited in claim 1 further comprising:

a spring-loaded mounting structure coupled to the low-band radiating structure.

3. The apparatus recited in claim 1 wherein the low-band radiating structure operates between about 20 MHz and about 500 MHz, the medium-band radiating structure operates between about 120 MHz and about 1 GHz and the high-band radiating structure operates between about 500 MHz and about 6 GHz.

4. The apparatus recited in claim 1 wherein the hybrid biconical dipole radiating structure comprises an upper tapered conical dipole radiating element coupled to a lower tapered conical dipole radiating element by way of a balun.

5. The apparatus recited in claim 1 wherein the medium-band radiating structure comprises upper and lower dipole elements coupled to a dual section coaxial transformer.

6. The apparatus recited in claim 1 wherein the high-band feeder line cable makes a 540 degree arc around the mid-band feed point while providing a 180 degree phase imbalance necessary for proper mid-band operation.

7. The apparatus recited in claim 1 wherein the spring-loaded mounting structure comprises:

top and bottom plates;

a plurality of laterally-offset springs coupled between the top and bottom plates.

8. The apparatus recited in claim 1 wherein the spring-loaded mounting structure comprises:

a top plate for connecting to the antenna structure;

a bottom plate for connecting to a vehicle; and a plurality of laterally-offset springs coupled between the top and bottom plates.

9. The apparatus recited in claim 1 wherein the is enclosed by flexible bellow that is secured to the top and bottom plates.

10. The apparatus recited in claim 1 wherein the spring-loaded mounting structure comprises molded rubber elements disposed within each of the springs.

* * * * *